United States Patent [19]

Zanetta

[11] 4,277,054

[45] Jul. 7, 1981

[54] MULTIFLOW REFINING BLASTPIPES FOR EQUIPPING CONVERTERS FOR REFINING

[75] Inventor: Hugues Zanetta, Metz, France

[73] Assignees: Creusot-Loire, Paris; Emile Sprunck, Moyeuvre Grande, both of France

[21] Appl. No.: 91,138

[22] Filed: Nov. 5, 1979

[30] Foreign Application Priority Data

Nov. 29, 1978 [FR] France ..... 78 33911

[51] Int. Cl.[3] ..... C21B 7/16

[52] U.S. Cl. ..... 266/268

[58] Field of Search ..... 266/268; 75/60

[56] References Cited

U.S. PATENT DOCUMENTS

| | | | |
|---|---|---|---|
| 3,781,002 | 12/1973 | Courard | 266/268 |
| 3,898,079 | 8/1975 | Eriksson | 266/268 |
| 4,023,781 | 5/1977 | Fritz | 75/60 |
| 4,040,612 | 8/1977 | Leroy | 266/268 |

*Primary Examiner*—P. D. Rosenberg

*Attorney, Agent, or Firm*—Haseltine and Lake

[57] ABSTRACT

Improvements in multiflow refining blastpipes for equipping converters for refining and including at least two concentric tubes 1 and 3, which define between them an annular gap 4 and an annular ring 8 connected by welding onto the outer tube 3, which consist in arranging at the end of the outer tube 3 which is located next to the inlet for the fluids into the blastpipe, a shoulder 12 prolonged by a cylindrical portion 13 which defines an annular chamber 14 for the introduction of a protective fluid, and in arranging the annular ring 8 on the said cylindrical portion 13.

2 Claims, 2 Drawing Figures

MULTIFLOW REFINING BLASTPIPES FOR EQUIPPING CONVERTERS FOR REFINING

FIELD OF THE INVENTION

The present invention refers to improvement in multiflow refining blastpipes for equipping converters for refining metals.

BACKGROUND

These blastpipes consist essentially of a central tube through which is blown a refining agent, for example, oxygen, and at least one outer tube concentric with the first and defining with it an annular space through which is injected a protective fluid. For certain operations a number of tubes arranged concentrically are employed, which enables distinct fluids to be introduced into the converter independently of one another.

The majority of refining blastpipes, whatever their type, exhibit on the circumference of the peripheral tube an outer ring which fulfills a double function: to ensure on the one hand the sealing of the converter at the place of insertion of the blastpipe, and to enable on the other hand the securing of special claws for extraction of the blastpipe out of the converter in case of need.

This ring is generally connected by welding onto the circumference of the outer tube. The result of this is in general a deformation over the inner wall of the outer tube at the level of the ring. This deformation is characterized by a slight swelling causing a local contraction of the inner diameter of the tube.

In the case of multiflow blastpipes this contraction affects the geometry of the annular gap and consequently prejudices the operation of these blastpipes, particularly of those having an annular gap of very small thickness.

The usual solution consist in subsequent re-machining of the inside of the tube. It is clear that such a supplementary intervention cannot but burden the cost of manufacture of the blastpipes.

SUMMARY OF THE INVENTION

The aim of the present invention is to apply a new solution which enables the operation of recalibration of the outer tube to be avoided.

For this purpose the object of the invention is a multiflow refining blastpipe for equipping converters for refining, and including at least two concentric tubes which define between them an annular gap, and an annular ring connected by welding to the outer tube, characterized in that the outer tube exhibits in the vicinity of the end of it which is located next to the inlet for the fluids into the blastpipe a shoulder prolonged by a cylindrical portion which defines with the inner tube an annular chamber wider than the said annular gap and in that the said annular ring is connected onto the said cylindrical portion.

The annular ring connected onto the said cylindrical portion may advantageously be located in the vicinity of the said shoulder.

The invention will be better understood and other aspects and advantages will become more clearly apparent upon examination of the description which follows, given with reference to the attached drawings.

BRIEF DESCRIPTION OF THE DRAWINGS

In the two Figures the same parts are referenced by identical reference numbers.

DETAILED DESCRIPTION

Figure 1:
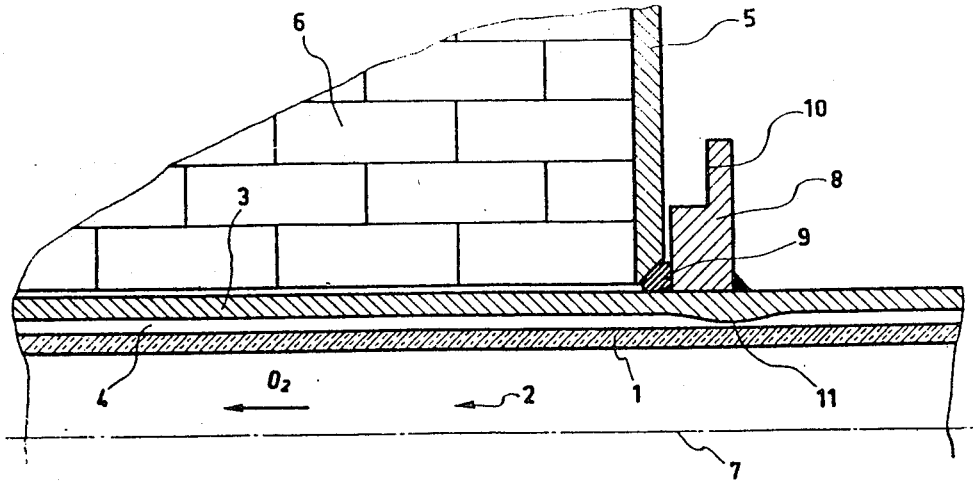
FIG. 1 represents a partial longitudinal section of a refining blastpipe of known type.

As may be seen, the blastpipes shown consist essentially of two concentric tubes: an inner tube 1, generally of copper, which defines a central duct 2 for blowing in oxygen in the direction indicated by the arrow, and an outer tube 3 usually of steel and defining with the tube 1 an annular gap 4 for the flow of a protective fluid, for example, gaseous or liquid hydrocarbons, liquid $CO_2$, etc. These blastpipes usually pass through the bottom of a steelworks converter the metal plating of which, known as the bottom plate, has been partially represented at 5, and the inner refractory lining at 6. 7 likewise designates the axis of the blastpipe which coincides with that of the passage arranged in the bottom of the converter for the insertion of it. As may be seen, the outer tube 3 exhibits on its circumference an annular ring 8 which ensures the sealing of the converter by compressing a toroidal seal 9. This ring exhibits at its upper part a bearing surface 10 the particular geometry of which must enable the anchoring of special claws for pulling the blastpipe out of the converter when that is necessary. As may be seen, this annular ring is connected onto the outer tube 3 by welding. Taking into account the small thickness of the tube 3 (a few millimeters), the operation of welding generally causes deformation and oxidation of the tube at this place. This deformation appears in the form of a slight swelling 11 on the inner surface of the tube 3. In the case of FIG. 1, where the blastpipe consists of two cylindrical tubes, the swelling 11 causes as may be seen a local contraction of the annular gap 4. This contraction disturbs the flow of the protective fluid and consequently affects the good operation of the protective system of the blastpipe and may consequently be the source of premature deterioration of the latter.

Figure 2:
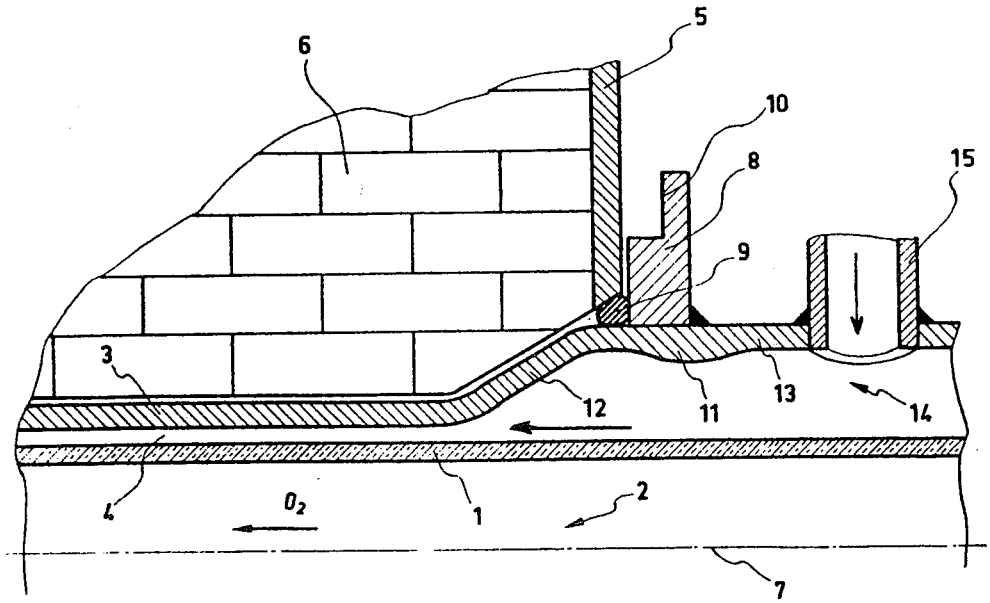
FIG. 2 represents a partial longitudinal section of a refining blastpipe in accordance with the invention.

Referring now to FIG. 2, the solution in accordance with the invention consists firstly of making use of an outer tube 3 which exhibits at the end of it a shoulder 12 prolonged by a cylindrical portion 13. The shoulder 12 is produced by cold working and its role consists, in combination with the cylindrical portion 13, in arranging between the tube 3 and the tube 1 an annular chamber 14 for feeding with protective fluid. The latter is introduced in the direction indicated by the arrows through the inlet stub 15 connected to a source under pressure (not shown). Secondly, the solution consists in connecting the ring 8 onto the cylindrical portion 13 between the stub 15 and the shoulder 12.

In this way the deformation 11 due to the welding takes place no longer in the annular gap 4 but in the chamber 14, that is to say, in a place of low speed of flow of the protective fluid.

Hence more generally the invention consists in placing the ring 8 at a place such that the local deformation caused by welding is without sensible effect upon the annular gap. The advantages obtained may be enumerated in the following way:

the annular gap is no longer deformed;

the deformation is produced in the protective fluid feed chamber, which is without effect upon the operation of the blastpipe and hence upon its working life, since this chamber is wide in contrast to the annular gap.

Thus one avoids the necessity of subsequent remachining of the inner surface of the outer tube, which contributes to reducing substantially the cost of manufacture of the blastpipe.

Of course in order to enable the ring 8 to ensure its sealing function it is necessary as shown in FIG. 2 to provide an adaptation of the aperture in the bottom of the converter to the presence of the shoulder 12.

The invention is applicable to any multiflow blastpipe, especially to those having an annular gap of small thickness, which are known to be very sensitive to any accidental deformation of their geometry.

I claim:

1. A multiflow refining blastpipe through which fluids are introduced into a converter from an inlet for said fluids, and comprising at least two concentric tubes which define between them an annular gap, and an annular ring connected by welding to the outer tube, wherein the outer tube exhibits in the vicinity of the end of it which is located next to the inlet for the fluids into the blast-pipe a shoulder prolonged by a cylindrical portion which defines with the inner tube an annular chamber wider than said annular gap and in that said annular ring is arranged on said cylindrical portion.

2. The refining blastpipe as in claim 1, wherein said annular ring is arranged on the cylindrical portion of the outer tube in the vicinity of said shoulder.

* * * * *